United States Patent [19]

Eichholz

[11] Patent Number: 4,485,944

[45] Date of Patent: Dec. 4, 1984

[54] DISPENSER WITH QUICK-RELEASE DRIVE SCREW

[75] Inventor: Arthur H. Eichholz, Polo, Ill.

[73] Assignee: Central Quality Industries, Inc., Polo, Ill.

[21] Appl. No.: 372,108

[22] Filed: Apr. 27, 1982

[51] Int. Cl.[3] ..... B65D 83/00

[52] U.S. Cl. ..... 222/390; 411/433; 411/437

[58] Field of Search ..... 222/390, 326, 327; 411/432, 433, 437; 401/172-175

[56] References Cited

U.S. PATENT DOCUMENTS

| | | | |
|---|---|---|---|
| 1,876,797 | 9/1932 | Treleven | 222/390 X |
| 2,421,711 | 6/1947 | Moots et al. . | |
| 2,956,563 | 10/1960 | Sarnoff | 222/327 X |
| 3,250,443 | 5/1966 | Abbott, Jr. . | |
| 3,358,699 | 12/1967 | Bau | 401/172 |
| 3,842,877 | 10/1974 | Andrews . | |
| 4,253,589 | 3/1981 | Kiste, Jr. . | |

FOREIGN PATENT DOCUMENTS

| | | |
|---|---|---|
| 4718 | of 1912 | United Kingdom . |
| 8294 | of 1913 | United Kingdom . |

*Primary Examiner*—F. J. Bartuska

[57] ABSTRACT

A screw-actuated dispenser comprising a receptacle for accommodating a cartridge containing viscous material such a caulk, grease or the like. The receptacle has opposing endwalls between which the cartridge is confined. An elongate drive screw is threadably engaged with a threaded opening in the rear endwall and is extensible within and retractable from the opening and relative to the body by rotation. A slot extends partially along the length of the body and connects with the rear wall opening. A wedge is positioned in the slot, expanding the opening and urging the threads on the drive screw and those within the opening out of engagement with the screw such that the drive screw is freely slidable longitudinally relative to the receptacle. To engage the drive screw in the opening, the slot is compressed by a sleeve extended over an extension of the rear wall on opposite sides of the slot.

6 Claims, 7 Drawing Figures

DISPENSER WITH QUICK-RELEASE DRIVE SCREW

FIELD OF THE INVENTION

This invention relates to dispensing apparatus and more particularly to a unique quick-release actuator for a dispensing apparatus.

DESCRIPTION OF THE PRIOR ART

Traditionally, caulk, grease or like material is retained within a cylindrical cartridge having a discharge nozzle at one end and an internal slidable plunger. The material in the cartridge is generally discharged by a dispenser having a receptacle, contoured to the cartridge configuration, and opposing endwalls between which the cartridge is confined. The rear endwall threadably receives a drive screw having a handle on one end and a pressure plate on the opposing end which is engageable with the cartridge plunger. By rotating the drive screw, the pressure plate can be advanced into or retracted from the cartridge. Movement of the plunger towards the nozzle compresses the material until it extrudes through the nozzle.

It is desirable to back off the drive screw when the discharge becomes excessive or when the material is exhausted from the cartridge. Heretofore, the threaded engagement between the drive screw and wall have necessitated that this be accomplished by reversely rotating the drive screw. Consequently, the discharge of material might continue while the operator is rotating the drive screw to relieve the pressure on the cartridge plunger.

To partially overcome this problem, a quick release capability has been incorporated into numerous apparatus, notably that in U.S. Pat. No. 4,253,589, to Kiste, Jr. In Kiste, Jr., the threads are interrupted along a portion of the drive screw adjacent either end. A pair of spaced openings are provided in the rear wall and are interconnected by a narrow slot. When the portion having the interrupted thread, which thus accounts for a reduced cross-sectional area, intersects the slot, the drive screw can be pivoted sideways through the slot until it intersects the adjacent hole, which is of a larger diameter. The drive screw can then be moved freely longitudinally through this separate opening without effecting rotation.

A similar arrangement is disclosed in British Pat. No. 4718 of 1912, to Atkinson et. al. While Atkinson et. al. describes a closed container that obviates the need for a cartridge, the operating principle is the same. A pressure plate is pivotally attached to the end of the drive screw, which is threaded intermediate its ends leaving a thinner, unthreaded section adjacent both extremities. A pair of adjacent openings are disclosed as in Kiste, Jr., with movement of the drive screw from one to the other restricted so as to only pass the reduced cross-sectional area. Once the drive screw is aligned with the alternate and larger opening, it can be freely moved longitudinally without interference from the threads.

As discussed previously, both Kiste, Jr. and Atkinson et. al. have the disadvantage that they do not permit quick release of the drive screw other than either during the initial introduction of the drive screw into a full cartridge or during extraction of the screw from an empty cartridge. Further, a more complicated arrangement is necessitated between the end of the drive screw and the pressure plate, in that for effective operation, the pressure plate must be pivotable so as to be continually aligned with the plunger in the cartridge.

SUMMARY OF THE INVENTION

The present invention comprises a screw-actuated dispenser comprising a receptacle for a cartridge with opposing endwalls between which the cartridge is confined. One endwall has an opening which threadably engages the drive screw, which, when rotated, is extensible within or retractable from the opening and relative to the body. The receptacle has a slot extending from the opening and permits said opening to be expanded to disengage the threads within the opening from those of the drive screw.

It is the principal object of the present invention to provide an arrangement whereby the drive screw can be quickly extended or retracted at any position where it resides relative to the receptacle. With the opening expanded, the drive screw can be moved longitudinally relative to the receptacle without interference between the threads.

In a preferred arrangement, the slot extends along the length of the body which is fabricated from a resilient material. A wedge is introduced to expand the slot, urging the threads about the opening out of engagement with those on the drive screw.

To actuate the drive screw, the slot is compressed and the threads engaged. To accomplish this, the rear wall is extended longitudinally and on opposite sides of the slot. The extension on opposite sites of the slot is captured and compressed by a sleeve that is coaxially arranged on the drive screw. The sleeve is advanced toward the rear wall to compress the slot and is maintained upon the extension by the opposing residual forces on the extensions imparted by the wedge in the slot. When the sleeve is backed away from the rear wall, the opening will assume its original expanded configuration.

To facilitate manipulation of the sleeve, an expanded disc-shaped member is attached at one edge of the sleeve. The member is fit closely over the drive screw to maintain the alignment of the sleeve and rear wall extension and defines an annular shoulder which can be conveniently grasped and drawn to remove the sleeve.

A pressure plate is attached at the end of the drive screw, which plate is designed to abut the flat surface of a plunger within the cartridge. Because the drive screw is consistently aligned longitudinally with the receptacle, the plate can be rotatably secured to the end of the screw and will flushly abut the plunger.

DESCRIPTION OF THE PREFERRED EMBODIMENT

Figure 1:
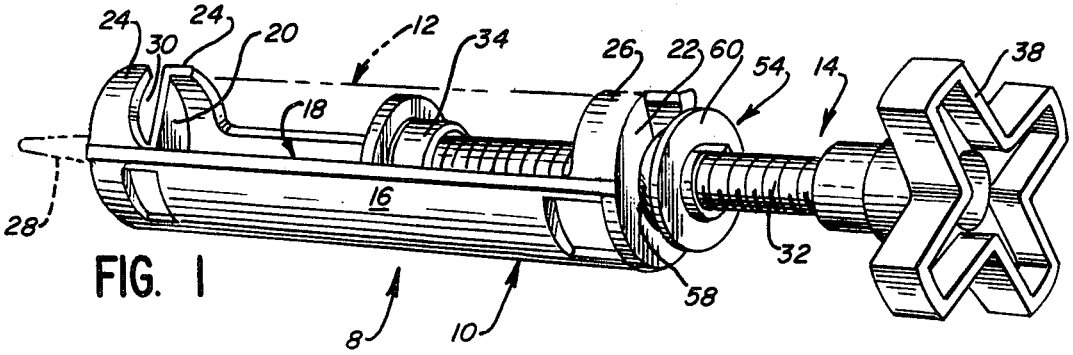
FIG. 1 is a perspective view of a screw-actuated dispenser incorporating the quick-release drive screw arrangement of the present invention.
Figure 2:
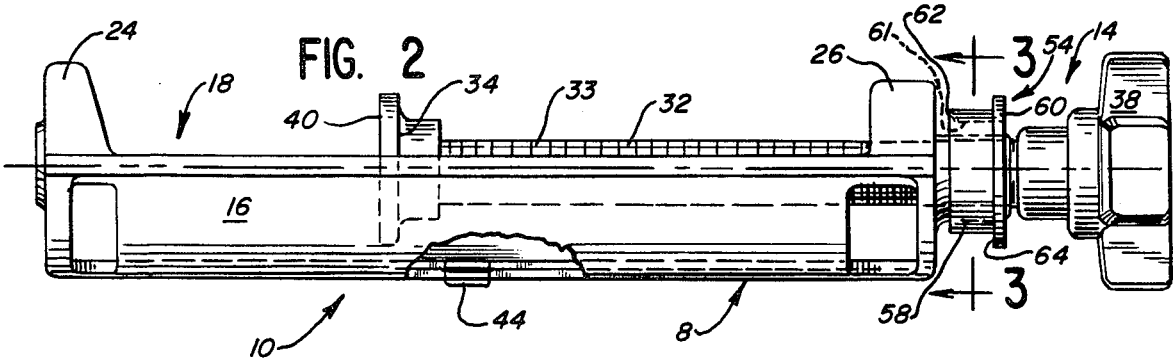
FIG. 2 is an elevational side view of the dispenser.
Figure 4:
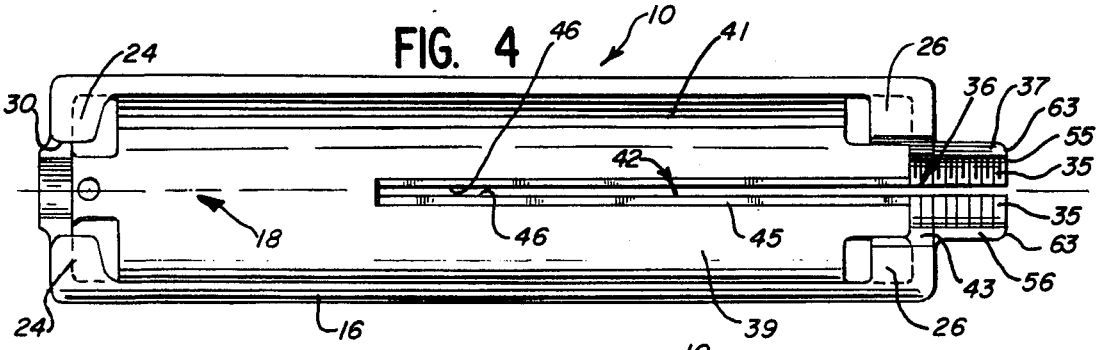
FIG. 4 is a top view of the dispenser receptacle as it comes from the mold.
Figure 5:
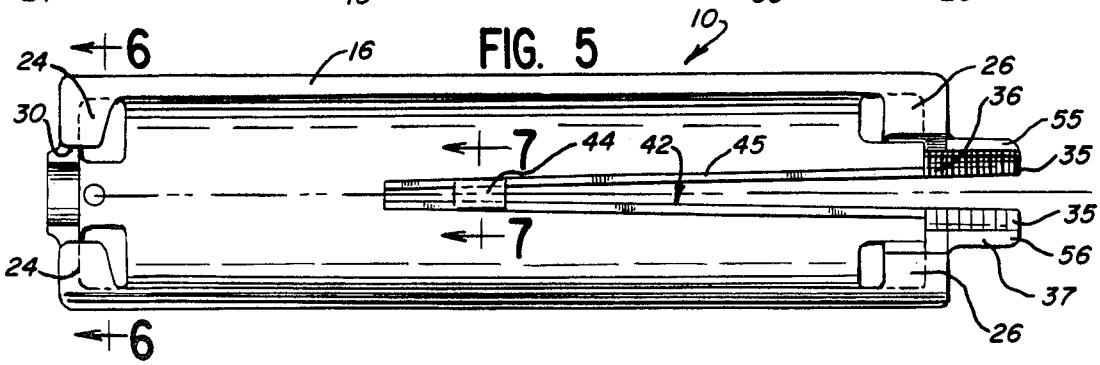
FIG. 5 is a top view of the receptacle of FIG. 4 with the threaded opening expanded for release of the drive screw.

Referring initially to FIGS. 1 and 2, a preferred form of the invention is shown to include, generally, a dispenser 8 having a receptacle 10 for a cylindrical material containing cartridge 12 (illustrated in phantom) and a screw-drive arrangement 14.

The receptacle 10 is preferably molded as from ABS plastic or other resilient material. The receptacle 10 as shown in FIGS. 1–6, comprises an elongate body 16 defining a curved upwardly facing region 18 contoured to define a cradle for the cartridge 12.

The body 16 has substantially circular front and rear endwalls 20 and 22, respectively, between which the cartridge 12 is confined. The spacing of the endwalls is slightly greater than the length of the cartridge 12 to facilitate loading. The upper regions of the front and rear endwalls 20, 22 are extended towards each other and respectively define curved shrouds 24, 26 over the ends of the body 16. The shrouds 24, 26 serve to confine upward shifting of the cartridge 12 during use.

The cartridge is introduced with one of either the front or rear end (not shown) elevated while introducing the other end to the receptacle into abutting engagement with the respective endwall 20 or 22. The elevated end of the cartridge 12 will then clear the overlying shrouds 24, 26 and can be lowered against the body 16. To accommodate the nozzle 28 at the end of the cartridge 12, a U-shaped cutout 30 is provided in the front endwall 20.

The drive arrangement 14 comprises an elongate drive screw 32 with a continuous thread 33 throughout its length provided adjacent its forward end with a pressure plate 34 which is engageble with a plunger (not shown) facing rearwardly from within the cartridge 12 and slidable within and along the length of the cartridge 12. The drive screw 32 rotates relative to the pressure plate 34 in a manner well known in the art. The drive screw 32 is threadably engaged with threads 35 within opening 36 in the rear endwall 22. A handle 38 is rigidly fixed to the rear of the drive screw to effect rotation of the drive screw 32. Rotation of the drive screw 32 advances the pressure plate 34 within or retracts the pressure plate from the cartridge. By advancing the drive screw, the plunger (not shown) is urged toward the nozzle, compressing the material in the cartridge until it extrudes from the nozzle 28. The plate 34 has a flat circular face 40 that is engageable with a corresponding flat surface on the plunger. The fact-to-face engagement maintains a constant orientation of the plunger as it is advanced by the drive screw 32.

The quick-release capability of the drive screw is incorporated into the dispenser 8 as described below. An elongate slot 42 is initially molded or formed in the bottom of the body 16 and extends lengthwise of the body from a point forward of the mid portion of the body 16 to and including the threads 35 in the opening 36 in the endwall 22 and integral flange 37 on said endwall 22. Diametrically opposite the slot 42 in the flange 37, endwall 22 and shroud 26 is a wedge-shaped cutout 43. The slot 42, except in the vicinity of the threads 35, has an undercut 45 on the edge of the slot joining the upwardly facing region 18 of the cradle. The slot 42 is expanded laterally by forcing a wedge 44 toward the front of the receptacle 10. The divided sides 39, 41 of the receptacle, the endwall 22 and the flange 37, divided by the slot 42 and cutout 43, move laterally way from each other as the wedge 44 is driven home. This expands the slot and the sides of the opening 36 so that the threads 35 in the threaded segments of the endwall 22 and flange 37 by an amount sufficient to clear the threads on the drive screw 32. With the opening 36 and segments of threads 35 expanded, the drive screw can be moved within the opening 36 along its entire length without interference between the threads on the screw 32 and the threads 35 on the receptacle 10.

Figure 7:
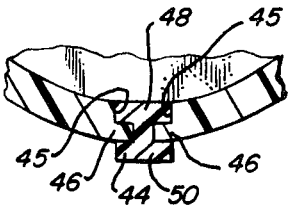
FIG. 7 is an enlarged partial sectional view of a wedge in place to expand the slotted receptacle and taken along line 7—7 of FIG. 5.

The details of the wedge 44 are shown in FIG. 7, wherein the wedge 44 is preferably I-shaped with the opposing edges 46 of the body 16, defining the slot 42, captured between the upper and lower cross-pieces 48, 50 of the wedge 44. To keep the wedge 44 from protruding upwardly past the surface of the receptacle and thereby interfering with the cartridge, longitudinal, downwardly recessed undercuts 45 are provided in the body edges for nestably receiving the upper cross-piece 48 of the wedge. The wedge is permanently secured in position by adhesive, by staking or the like. The engagement of the body with the wedge, when the wedge is fully seated as in FIG. 5, minimizes the relative flexure of the body on opposing sides of the slot.

Figure 3:
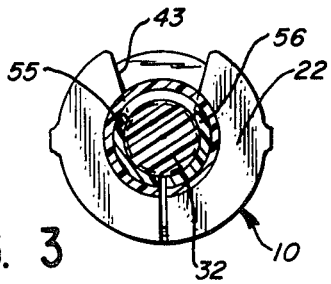
FIG. 3 is a sectional view of the drive screw and clamp for compressing the end of the receptacle against the drive screw taken along line 3—3 of FIG. 2.
Figure 6:
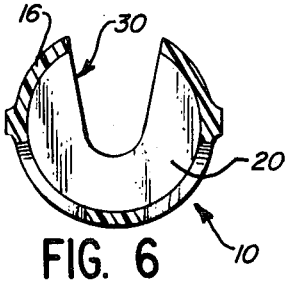
FIG. 6 is a sectional view of the front end of the receptacle taken along line 6—6 of FIG. 5.

To engage the threads 33 on the drive screw 32 with the segments of threads 35 in the opening 36, a clamping ring 54 is provided as shown in FIGS. 1–3. The flange 37 extends longitudinally of the rear wall 22 and includes the arcuate segments 55,56 which contain the threads 35. The threads 35 extend through the opening 36 in the flange 37 and endwall 22. When the threads in the opposing segments 55,56 are urged toward each other, the opening 37 will be compressed and the threads 33 on the drive screw 32 will be drivingly engaged by the threads 35 in the opening 36.

The clamping ring 54 is comprised of a sleeve 58 and a collar 60 on one external end thereof. The sleeve 58 has a bore 61 with an internal diameter which is slightly larger than the external diameter of the outer surface of the flange 37 when the flange 37 is in the initial relaxed condition of FIG. 4, prior to wedging the slot 42. The forward portion 62 of the bore 61 of the sleeve 58 is tapered or flared outward to act as a guide for guiding the ring 54 onto the flange 37. The outer surface of the end portion 63 of the flange 37 is tapered or flared inward so as to further assist in guiding the ring 54 onto said flange 37. The ring 54, when advanced toward the endwall 22, surrounds the arcuate segments 55,56 of the flange 37, urging the segments 55,56 towards each other, reducing the size of the opening 36 and engaging the threads 35 in the flange 37 and endwall 22 with the threads 33 on the screw 32. Turning the handle 38 will advance or retract the screw 32 in the receptacle 10. The outwardly directed forces of the divided sides 39,41 of the receptacle 10 will act through the segments 55,56 of the flange 37 to retain the ring 54 on the flange 37. The wedge 44 in the slot 42 acts as a fulcrum about which the two sides 39,41 of the receptacle pivot. To release the screw 32, the ring 54 is grasped and pulled toward the handle 38, releasing the flange 37 and endwall 22 whereby the threads 35 therein disengage from the threads 33 on the screw 32. The screw 32 is now free to be moved longitudinally in either direction as desired. When it is desired to re-engage the screw 32, the sides 39,41 are squeezed together until the ring 54 can slip over the end of the flange 37 whereupon forward pressure on the collar relative to the endwall 22 will move the ring 54 onto the flange, will engage the threads 35 in the flange with the threads 32 on the screw and will arm the dispenser ready for turning the handle 38 to dispense the caulk, grease or the like from the cartridge in the cradle of the receptacle 10.

The foregoing description was made for purposes of clarifying the operation of the invention with no unnecessary limitations to be derived therefrom.

I claim:

1. A screw-actuated dispenser comprising:

a receptacle for a cartridge comprising an elongate body made at least partially from a resilient material for accommodating a cartridge and front and rear walls at opposing ends of the body between which the cartridge is confined;

an elongate drive screw with threads along its length and a pressure plate adjacent the front end of the drive screw for engagement with an end of the cartridge;

a handle secured adjacent the rearward edge of the drive screw for actuating the drive screw;

an opening in said rear wall within which said drive screw is received;

threads within said opening matable with the threads on said elongate drive screw, said drive screw selectively advanced within or retracted from said opening and relative to the length of the receptacle by rotation;

a slot extending lengthwise of the body and joining with said opening in the rear wall;

wedge means fixedly located in the slot between the front and rear walls and deforming the body so as to widen said slot and in turn enlarge said opening such that the threads within the opening are biasably urged away from the threads on the drive screw;

second means extending rearwardly from said rear wall and having a slot portion connecting with the opening in the rear wall; and clamp means selectively engageable with the second means to constrict the opening and bring the threads on the drive screw into intimate engagement with the threads in the opening, whereby quick-release of the drive screw can be effected by removing the clamp means from the second means.

2. The dispenser of claim 1 wherein said opening is substantially circular and said second means comprise at least two arcuate sections extending longitudinally from said rear wall and about said opening on opposite sides of said slot, and said clamp means include a sleeve positionable over said sections and urging said sections each towards the other and thereby constricting the opening so as to engage the threads within the opening with the threads on the drive screw.

3. The dispenser of claim 1 wherein the wedge means is substantially I-shaped in cross-section and captures opposing edges of the body defining the slot, thereby minimizing relative flexure of the body on opposing sides of the slot.

4. The dispenser of claim 2 wherein said sleeve is coaxially aligned with and slidable along said drive screw without effecting rotation, said clamp means confined between the receptacle and handle to prevent separation from the drive screw.

5. The dispenser of claim 3 wherein said body has a recessed longitudinal guide on opposing edges of the body defining the slot, so that the wedge does not protrude through the body and interfere with the cartridge.

6. The dispenser of claim 4 wherein a collar having a diameter in excess of that of the sleeve is formed at the rear edge of the sleeve, said collar having an aperture closely accepting the drive screw and being movable longitudinally with the sleeve into engagement with the arcuate sections.

* * * * *